United States Patent [19]

Shoales

[11] Patent Number: 4,774,873

[45] Date of Patent: Oct. 4, 1988

[54] SLEEVE RECUPERATOR

[75] Inventor: Gregory A. Shoales, Dayton, Ohio

[73] Assignee: The United States of America as represented by the Secretary of the Army, Washington, D.C.

[21] Appl. No.: 909,051

[22] Filed: Sep. 15, 1986

[51] Int. Cl.[4] ..... F41F 19/02

[52] U.S. Cl. ..... 89/43.01; 89/198

[58] Field of Search ..... 89/43.01, 198, 177

[56] References Cited

U.S. PATENT DOCUMENTS

| | | | |
|---|---|---|---|
| 3,668,969 | 6/1972 | Harbrecht et al. | 89/43.01 |
| 3,745,880 | 7/1973 | Metz et al. | 89/43.01 |

FOREIGN PATENT DOCUMENTS

| | | | |
|---|---|---|---|
| 3015126 | 9/1983 | Fed. Rep. of Germany | 89/43.01 |
| 131871 | 5/1951 | Sweden | 89/43.01 |

*Primary Examiner*—Stephen C. Bentley
*Assistant Examiner*—Stephen M. Johnson
*Attorney, Agent, or Firm*—Robert P. Gibson; Edward Goldberg; Edward F. Costigan

[57] ABSTRACT

A recuperator system for absorbing the recoil of a gun and returning the gun to battery comprises a sliding sleeve having a connecting member at one end thereof and a sealing collar at an opposite end thereof. The sealing collar slides against an outer surface of a cylinder which is disposed in the sliding sleeve. A second connecting member is connected to the sealing collar at an end thereof opposite to the first connecting member. The cylinder also carries a further sealing collar at an end adjacent the first connecting member. The further sealing collar is in sealing and sliding engagement with an inner surface of the sleeve and with an outer surface of a hollow piston rod connected to the first connecting member. The hollow piston extends axially within the cylinder and forms part of a Schneider system that contains hydraulic fluid for cushioning the recoil of the gun.

A gas space is defined between the cylinder and sleeve and between the collars. The space is compressed when the connecting members are moved apart by the recoil of a gun. The compression produces a restoring pressure to return the connecting members to their initial position and thus return the gun to battery.

5 Claims, 2 Drawing Sheets

SLEEVE RECUPERATOR

STATEMENT OF GOVERNMENT INTEREST

The invention described herein may be manufactured, used and licensed by and for the Government for Governmental purposes without the payment to me of any royalties thereon.

FIELD AND BACKGROUND OF THE INVENTION

The present invention relates in general to recoil systems for guns, and in particular to a new and useful recuperator system which functions to break the recoil of a gun and return it to battery, and which is lightweight, efficient and reliable.

Systems for braking the recoil of a gun must be at least reliable enough to consistently return the gun to battery, that is to its firing position.

Previously and on present tanks, such as the M-60 and M-1, this function has been performed by a concentric hydrospring mechanism which is neither lightweight, efficient nor reliable. This mechanism brakes the recoiling parts by throttling oil through an orifice in a large concentric cylinder centered around the gun tube. A mechanical spring fitted in the same cylinder is compressed by the displacement of recoil and therefore provides the restoring force at the end of the recoil stroke.

The concentric hydrospring has proven to be unsatisfactory for several reasons.

From experience with the M-60 tank system, the concentric hydrospring arrangement is susceptible to leaks of the recoil fluid which, if in excess, results in a major failure of the gun system.

The mechanical spring is slow to respond to the quick loading which it is subjected to and often breaks and thus fails to return the gun to battery. The large diameter of the hydrospring makes it difficult to control the size of the orifice and therefore the force transmitted to the trunnions of the gun. The mechanism has many parts and represents a sizable portion of the weight of the cannon system (1,700 lbs. on the M-60). Also, if the mechanism does fail, it is a major operation to place any or all of it. This cannot be done in the field.

Proposed future gun recoil systems include use of one or more smaller diameter Schneider type recoil brake cylinders and a separate recuperator cylinder for restoring the gun to battery. These cylinders are mounted on the gun/breach on one end, and the trunnions on the other.

The separate Schneider system offers solutions to most, if not all of the problems experienced with concentric mechanisms. It is smaller, lighter and has fewer parts. It has proven reliable on such gun systems as the Soviet T-55 and T-62. Should it need replacement, it requires an ordinary wrench and a matter of a few minutes to replace the entire unit.

The Schneider system could be further improved, however, if the recoil brake and recuperator could combine to eliminate the need to have two different replacement cylinders for spare parts. Present recuperator designs also involve a fairly complex transfer of oil volume to compress a gas volume by a specific amount, to provide the required restoring force for counter-recoil movement of the gun.

SUMMARY OF THE INVENTION

The present invention combines the recoil/counter-recoil function into a single cylinder by modification of a classic Schneider recoil brake cylinder.

One advantage of the invention is that only one type of cylinder need be maintained for spare parts. The addition of a very small number of parts to the basic Schneider mechanism accomplishes the same function of the separate recuperator cylinder. In addition, all the other advantages of the Schneider system are realized while most of the disadvantages of the concentric spring system are avoided.

Accordingly an object of the present invention is to provide a recuperator system for absorbing the recoil of a gun and for returning the gun to a firing position comprising a sliding sleeve, a connecting member connected to one end of the sliding sleeve, a sealing collar connected to an opposite end of the sliding sleeve, a cylinder disposed in the sleeve and having an outer surface in sliding and sealing engagement with the sealing collar, a further sealing collar connected to an end of the cylinder which is near the first connecting member, the further sealing collar being slidably and sealably engaged with an inner surface of the sleeve so that a gas space is defined between the sleeve and cylinder and between the sealing collars, and a hydraulic Schneider system inside the cylinder for absorbing recoil. The gas space is filled with a volume of gas. When the sleeve is slid outwardly with respect to the cylinder, the gas in the gas space is compressed which produces restoring forces that tend to slide the slide back into the cylinder. A second connecting member is connected to an opposite end of the cylinder. The second connecting member also carries a protective shield which engages around the outside of the sleeve and which has a dust seal that slidably engages against the outer surface of the sleeve.

A further object of the invention is to provide a recuperator system which uses concentric tubes to form a very compact structure which, at the same time, is highly efficient and reliable in absorbing recoil and returning a gun to a firing position.

The various features of novelty which characterize the invention are pointed out with particularity in the claims annexed to and forming a part of this disclosure. For a better understanding of the invention, its operating advantages and specific objects attained by its uses, reference is made to the accompanying drawing/s and descriptive matter in which a preferred embodiment of the invention is illustrated.

DESCRIPTION OF THE PREFERRED EMBODIMENT

Figure 1:
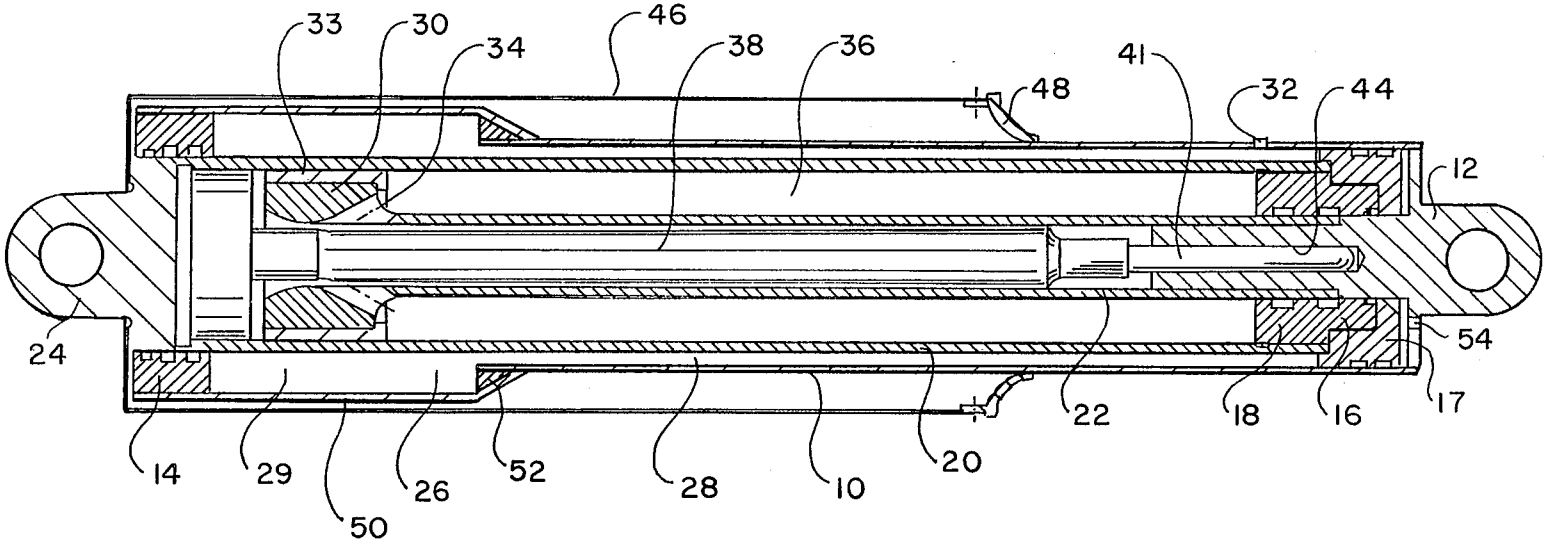
FIG. 1 is a sectional view of the recuperator system according to the present invention, in its initial condition before a gun connected to the system has been fired.

Referring to the drawings in particular, the invention embodied in FIG. 1 comprises a recuperator system having a sliding sleeve 10 with an inner sliding surface and an outer sliding surface. Sleeve 10 is cylindrical and has a first connecting member 12 connected to one end thereof. A first sealing collar 14 is connected to an opposite end thereof and has an inner sealing surface with a seal and scraper that slidably and sealingly engages an outer surface of a cylinder 20. A second sealing collar 16 is connected to one end of cylinder 20 which is adjacent connecting member 12. Second sealing collar 16 has a portion 17 with an outer sealing and bearing surface that slidably and sealingly engages against an inner surface of sleeve 10. Collar 16 also has an inner portion 18 which has an inner sealing and bearing surface that rides against the outer surface of a piston rod 22. Portions 17 and 18 are fixed together and to the cylinder 20.

A second connecting member 24 is fixed to an opposite end of cylinder 20.

In accordance with the invention, one of the connecting members 12 or 24 is connected or engaged with a gun barrel, generally near a breach of the gun barrel and the other connecting member 12 or 24 is connected to a trunnion of the gun. In this way, the gun barrel can recoil with respect to a fixed position mounting the gun, and then the gun can be restored to its firing position.

The restoring forces are provided by a volume of gas which fills the space 26 between sleeve 10 and cylinder 20 and between collars 14 and 16. Space 26 includes a first axially elongated portion 28 and a second radially enlarged portion 29. Together portions 28 and 29 form the total gas space 26. Gas can be filled into space 26 by a filling valve 32 connected into sleeve 10.

To facilitate connection of connecting members 12 and 24 to their respective positions on the gun assembly, each includes an eye.

Piston rod 22 has one of its ends connected to connecting member 12. An opposite end of rod 22 carries a piston 30 which has an outer sliding portion 33 that slides against an inner surface of cylinder 20. Piston 30 also includes a plurality of circumferentially spaced and obliquely extending ports 34 which provide communication between two portions of a hydraulic fluid space 36 which is defined between cylinder 20 and piston rod 22, the two portions of space 36 being separated by piston 30.

A plunger rod 38 is also fixed to second connecting member 24 and extends axially in hollow piston rod 22. A small diameter axial projection 41 at one end of rod 38 can be seated into a blind bore 44 which is defined in an axial projection of first connecting member 12.

A protective shield 46 is also fixed to second connecting member 24 and extends axially over at least a portion of sleeve 10. An elastomeric dust seal 48 engages against an outer surface of sleeve 10, keeping that surface clean.

Radially enlarged portion 29 of space 26 is defined by a reservoir sleeve 50 which is fixed to and forms a part of sleeve 10 by a sleeve adaptor 52.

The volume of portion 29 is selected to add to the volume of portion 28 so that the total volume of space 26 provides a desired compression ratio (usually 2:1) for a complete extension of the recuperator and a complete retraction thereof for breaking and absorbing recoil and thereafter returning the gun to battery or its firing position.

The tubular members such as sleeve 10 and 50, cylinder 20, shield 46 and piston rod 22, can all be made of steel tubing having stock sizes with a gauge which depends on the operating pressure to be exerted on the tubes. The dust seal 48 can also be a neoprene wiper. Valve 32 can also be of a type which is readily commercially available. The remaining parts such as connecting members 12 and 24, collars 14 and 16, adaptor 52 and the parts forming piston 30 may be machined.

In fabrication, sleeves 10 and 50, adaptor 52, collar 14 and connecting member 12 can be welded together. It is also noted that connecting member 12 includes a hole 54 which admits air into a space formed when connecting members 12 and 24 are pulled apart by the recoil of a gun. This avoids the formation of a vacuum in newly formed space. This is described in greater detail hereinunder.

Shield 46 can also be welded to second connecting member 24.

Sleeves 10 and 50 and their adaptor 52 can also be filament wound around parts which are similar to sleeves 14 and 12. This method of fabrication has been employed on a bore evacuator for a new type 120 mm tank gun.

In operation, when a gun having the inventive recuperator mounted thereon is fired, its recoil causes connecting members 12 and 24 to rapidly move apart from each other. This reduces the volume of hydraulic space 36 between piston 30 and collar 16, causing hydraulic fluid to move rapidly through ports 34. This dampens and brakes the recoil force of the gun while at the same time permitting connecting members 12 and 24 to move apart.

Figure 2:
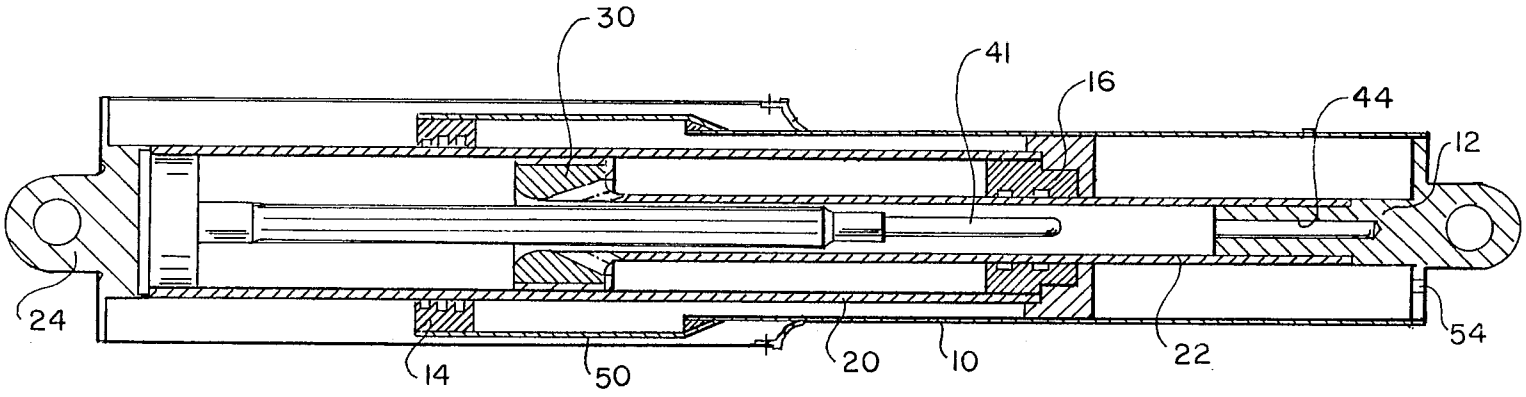
FIG. 2 is a view similar to FIG. 1 but on a reduced scale, showing the recuperator system in an extended position after the system has absorbed recoil and before the system has returned the gun to battery, that is its firing position.

The movement also causes a reduction of volume for gas space 26 as collars 14 and 17 move together. At some point during the recoil stroke, the force exerted by the pressure of gas in space 26 overcomes the recoil force. This point is shown in FIG. 2 and represents the maximum stroke of outward movement between connecting members 12 and 24. At this point the pressure of gas in space 26 forces the enlargement of this space, thus causing connecting members 12 and 24 to start moving back toward each other. Hydraulic fluid again passes through ports 34, but in an opposite direction to move the recuperator system back to the position shown in FIG. 1.

During the return stroke, plunger rod 38 moves into the bore of hollow piston rod 22, acting to cushion the return stroke. The return stroke is further cushioned by the insertion of projection 41 into the blind bore 44 of connecting member 12.

According to the present invention, rather than using a recoil cylinder with a mechanical compression spring, a gas spring in the form of compressed gas in space 26 is used to restore the gun to battery. The volume of gas supplied to space 26 can be tailored to provide a desired compression ratio and hence any desired restoring force at the end of the recoil stroke.

The initial pressure which is preset in space 26 after assembly, is usually such that the force exerted on the recoiling parts by the cylinder, when in battery, is around 110% of the weight of the recoiling parts.

A recoil brake "brakes" the recoil by absorbing the impulse of the firing gun. It does this by taking a very short duration high impulse and spreading out over time so the magnitude is a lower value. This allows the gun system to have a smaller attach point (trunions), stressed to the lower magnitude. The recuperator returns the gun to the forward firing position (battery), and then holds it there. It is simply a spring, in the cse of this invention, a gas spring. The recoil brake has the additional feature (41 & 44 in FIG. 1) which slows the gun's return in the final inches of travel and prevents it from slamming into battery. This invention is a combined recuperator/recoil brake. The recoil brake consists of the parts radially inward of part 20. The recuperator consists of the part radially outward of part 20.

While a specific embodiment of the invention has been shown and described in detail to illustrate the application of the principles of the invention, it will be understood that the invention may be embodied otherwise without departing from such principles.

What is claimed is:

1. A recuperator system for absorbing the recoil of a gun and for returining the gun to a firing position, comprising:

a sliding sleeve having an inner sliding surface;

a first connecting member connected to one end of said sliding sleeve;

a first sealing collar connected to an opposite end of said sleeve;

a cylinder disposed in said sliding sleeve and having inner and outer sliding surfaces, said first sealing collar being slidably and sealingly engaged with said outer sliding surface of said cylinder;

a second sealing collar connected to one end of said cylinder which is adjacent said first connecting member, said second sealing collar being slidably and sealingly engaged with said inner sliding surface of said sliding sleeve;

said outer sliding surface of said cylinder and said inner sliding surface of said sliding sleeve defining a gas space between said first and second sealing collars, said gas space being filled with a selected quantity of gas, said sliding sleeve forming with said cylinder a first sleeve portion and a second sleeve portion, said second sleeve portion communicating with said first sleeve portion, said first sleeve portion being longer axially than radially and said second sleeve portion being axially shorter and radially longer than said first sleeve portion, said quantity of gas in said first and second sleeve portion selected to produce a selected compression ratio for said gas space when said gas space is at its maximum volume and minimum volume;

a second connecting member connecting to an opposite end of said cylinder;

a cylindrical protective shield fixed to said second connecting member and extending over said second sleeve portion and over at least part of said first sleeve portion, and a dust seal fixed to said cylindrical protective shield and engaged against an outer surface of said first sleeve portion;

a piston rod connected to said first connecting member and extending in said cylinder, said piston rod having an outer sliding surface, said second sealing collar being slidably and sealingly engaged with said outer sliding surface of said piston rod; and a piston connected to said piston rod at an opposite end of said piston rod from said first connecting member, said piston having at least one port therein and being in sliding engagement with said inner sliding surface of said cylinder, said inner sliding surface of said cylinder defining a hydraulic fluid space between the second connecting member and said second sealing collar, said piston dividing said fluid space;

whereby movement apart of said first and second connecting member due to a recoil of a gun causes compression of the gas in said gas space which produces a force tending to move the first and second connecting member back together.

2. A recuperator system according to claim 1 including a filling valve in said first sleeve portion spaced from said dust seal for filling said gas space with the quantity of gas.

3. A recuperator system according to claim 2 wherein said first connecting member has a hole therein communicating with a space deined by said sliding sleeve which enlarges with movement apart from said first and second connecting members and which is separated from said gas space by said second sealing collar.

4. A recuperator system according to claim 3 wherein said piston rod is hollow and defines a space communicating with said hydraulic fluid space, a plunger rod fixed to said second connecting member and extending toward said hollow piston rod.

5. A recuperator system according to claim 4 wherein said plunger rod has a small diameter axial projection projecting toward said first connecting member, said first connecting member having an axial projection with a blind bore therein for receiving said projection of said plunger rod.

* * * * *